United States Patent [19]

Stiévenart et al.

[11] 4,148,274

[45] Apr. 10, 1979

[54] PROCESSING APPARATUS

[75] Inventors: Emile F. Stiévenart, Hoboken; Leo N. Vackier, Borgerhout; Willy G. Verlinden, Edegem, all of Belgium

[73] Assignee: AGFA-GEVAERT N.V., Mortsel, Belgium

[21] Appl. No.: 621,519

[22] Filed: Oct. 10, 1975

[30] Foreign Application Priority Data

Oct. 15, 1974 [GB] United Kingdom ..... 44666/74

[51] Int. Cl.[2] ..... B05C 5/02; G03G 15/06

[52] U.S. Cl. ..... 118/2; 118/648; 118/650; 118/660; 118/643; 118/50; 118/411; 134/64 P; 354/317

[58] Field of Search ..... 118/DIG. 23, 314, 411, 118/2, 50, 423, 660, 643, 648, 650; 354/298, 317, 325; 355/10; 134/64 P, 122 P

[56] References Cited

U.S. PATENT DOCUMENTS

| | | | |
|---|---|---|---|
| 346,869 | 8/1886 | Sherck et al. | 118/411 |
| 3,133,484 | 5/1964 | Wright | 118/DIG. 23 |
| 3,407,786 | 10/1968 | Beyer et al. | 118/411 X |
| 3,498,257 | 3/1970 | Grefe et al. | 118/314 X |
| 3,511,160 | 5/1970 | Van Reusel | 354/298 |
| 3,621,814 | 11/1971 | Sugarman et al. | 118/411 |
| 3,654,896 | 4/1972 | Marx et al. | 118/325 X |
| 3,707,943 | 1/1973 | Matsumoto et al. | 118/DIG. 23 |
| 3,727,578 | 4/1973 | Saito et al. | 118/DIG. 23 |
| 3,774,521 | 11/1973 | Beck | 354/317 |
| 3,859,960 | 1/1975 | Lloyd | 118/660 |

*Primary Examiner*—John McIntosh
*Attorney, Agent, or Firm*—William J. Daniel

[57] ABSTRACT

An apparatus for liquid development of latent images on sheets or webs comprises a plurality of applicator stations which sequentially deliver processing liquid to the latent image bearing surface of the sheets or webs. The latter are transported above the respective applicator stations with the concerning surface in downward direction. A controlling mechanism provides for the arrestment of the liquid supply before the trailing edge of the sheet or web has passed over the respective applicator station for the provision of not wetting the backside of the latter. The apparatus is extremely suited for developing latent electrostatic half-tone images on a high polymeric support.

25 Claims, 14 Drawing Figures

PROCESSING APPARATUS

This invention relates to apparatus for use in the application of liquid media to materials in sheet or web form during their transportation through a treatment station.

An important field of use for the invention is apparatus for use in the application of liquid processing media to information-recording materials for the purpose of treating or developing images in or on such material. Thus the invention can be embodied in apparatus for applying liquid processing media to light-sensitive photographic materials, e.g., silver halide materials incorporating silver halide emulsions; and in apparatus for developing electrostatic images by means of a liquid developer or by means of toner material dispersed in a carrier liquid, using electrostatic, electrophoretic or like phenomena.

When applying a liquid processing medium to a dielectric or other recording material, e.g., a material in the form of a sheet or in the form of a continuous strip or web, it may be desired to run the recording material into contact with the surface of a body of the liquid medium. This is a desirable procedure particularly in certain types of developing processing techniques for developing electrostatic images. That procedure has various potential advantages, including that of a well controlled wetting of the surface of the sheet material. There are however practical problems in automating the application of liquid in this way, as is required in processing rooms when successive recording materials have to be quickly and conveniently treated to make the records available for use within a short space of time. One of these problems is that of ensuring that a proper supply of the treatment medium is always available at the correct surface level at the processing station for contact by successive recording materials, notwithstanding the take-up of processing medium by the recording materials as they pass through such station, and that unwanted depositions of processing liquid are avoided.

The present invention provides apparatus wherein a correct supply of processing medium is ensured for each of the successive sheets of recording material.

The term "sheet" material as used in the above definition, includes an individual sheet and a strip or web.

Moreover, the apparatus reveals itself of utmost importance when the associated pump has to be switched off as the trailing edge of a sheet material passes a certain position along its path, this position being predetermined to ensure that the pumping up of the liquid stops before the trailing edge of the sheet material reaches the liquid surface. This may be an important precaution in some electrographic or electro-ionographic processes because seeping of processing liquid as a consequence of capillary forces above the generally transparent recording material and onto its rear (top) surface would impair the processed record.

In cases in which liquid medium is drawn up against the bottom surface of the recording material by electrostatic forces, this phenomenon may possibly itself not occur until the whole of the trough of processing medium is covered by the recording material and when that is the case liquid will not seep over the leading margin of the sheet material even if the pump is in operation as the leading margin of the sheet material is passing over the trough.

According to the invention, there is provided: an apparatus comprising an open-topped trough for holding processing liquid, means for guiding sheet recording material through the apparatus along a path passing over said trough, pump means for pumping liquid upwardly into said trough to cause overflow of liquid therefrom and contact of the liquid surface with the charge bearing surface, forming the bottom surface of a recording material during its movement along said path, a start-stop control switch for said pump, which switch operates automatically in dependence on the movement of said sheet material along said path, so that during the passage of a given material through the processing station, the pump operates for a period of time related to the speed of travel of said material and to its length measured along said path, and wherein the pump automatically switches off as the trailing edge of said sheet material passes a certain position which is such that the pumping up of liquid stops before the trailing edge of the sheet material reaches the liquid surface. The pumping of liquid can commence during the passage of a sheet material through the processing station and at a moment when the leading margin of the sheet is just completing or has just completed its travel over the trough.

In some apparatus according to the invention there is means for holding sheet material against an overlying surface by suction during passage of the material through the processing station.

In other apparatus according to the invention the sheet material is supported at only its side edges so that it sags into the top of the trough from which the processing medium overflows.

In preferred embodiments of the invention the said trough is one of a plurality of such troughs, disposed in series along the said path for sheet material, and each of the troughs has an associated pump which automatically operated in dependence on the position or movement of the sheet material so that the pumps associated with the successive troughs are interrupted in sequence or are operated over overlapping periods of time, in synchronism with the advance of the sheet material.

Thus the invention includes apparatus for processing a recording material in sheet or web-form, comprising:

- a container for holding processing liquid,
- a plurality of troughlike applicator stations to which said processing liquid may be fed,
- a plurality of pump means, each pump means being associated with an applicator station and capable of pumping processing liquid from said container to its associated applicator station, in such a manner that a layer of processing liquid is built up at the overflow edges of each of said applicator stations,
- means for guiding the recording material through the apparatus with its recording face in subsequent contact with each of the layers of processing liquid,
- collecting means for collecting the residual processing liquid flowing over the edge of the applicator stations and
- switch means which are capable of de-energising the pump means in sequence before passage of the trailing edge of the sheet or recording material over the associated applicator station.

The invention enables apparatus to be provided which can work according to a rigorously uniform and reproducible processing cycle.

Particular reference is made to apparatus according to the invention which can be used for developing charge patterns produced on a dielectric sheet by the process described in U.S. Pat. No. 3,774,029 of Eric P. Muntz, Andrew P. Proudian and Paul B. Scott issued Nov. 20, 1973.

The process referred to makes use of a sheet of dielectric material onto which a charge build-up occurs during exposure to penetrating radiation while said sheet is kept in an imaging chamber which contains xenon or a gas mixture containing xenon or another high atomic number gas. Charge build-up is the result of the interception of electrons or positive ions by the sheet of dielectric material when the latter contacts or is at least in close proximity to an anode, respectively a cathode, said electrodes being also mounted in said imaging chamber.

In order to render the charge pattern on the dielectric sheet visible, extreme care must be taken to avoid contamination of the charge image by friction against guides, frame parts, rollers, etc., because this would result in parasitic charges which would interfere with the charge pattern itself.

Bearing in mind that the finished image will serve for diagnostic purposes and that the exposure, in some cases, cannot be repeated, for example when contrast enhancing media are used, the creation of artefacts interfering with the charge pattern itself must be anticipated at any cost.

Moreover, when the method according to the aforementioned United States Patent comprises the use of a recording material which is supported by a carrier, it is not at all impossible with present art processing apparatus that the developing liquid might "creep" between the recording sheet and the carrier itself, resulting in a dirty appearance of the finished image caused by parasitic toner deposition.

Apparatus can be constructed according to the present invention which avoids the above disadvantages.

The scope and spirit of the invention will now be exemplified in the light of a description of preferred embodiments and with reference to the following figures, in which.

Figure 1:
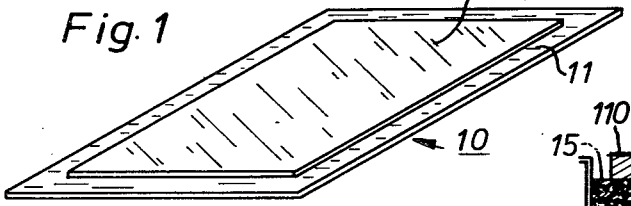
FIG. 1 is an isometric view of one form of a sheet material which may be used in combination with the invention.

As may be seen in FIG. 1 a material 10 e.g. a recording material comprises a carrier 11 which supports a sheet of recording material 12. In order to avoid unnecessary friction between the recording material 12 and machine-parts or rollers during the processing cycle, the carrier 11 has somewhat greater dimensions, so that it may be gripped by means engaging the edges only, such as small rollers, endless belts and the like. In so doing occasional friction occurs only between the concerned parts and the carrier edges, so that scratches or static electricity resulting from friction are only transferred to the carrier, whereas no harm to the vulnerable recording material occurs. If necessary, the backside of the carrier may be provided with a coating increasing its conductive properties. In the course of the description the combination of the carrier 11 and the sheet of recording material 12 as well as one sole sheet of recording material without carrier will be referred to as the recording material 10. It will be clear to those skilled in the art that when a sole sheet of recording material is used as an information carrier, the dimensions of the latter may be chosen in such a way that they are somewhat greater than those of the final image and that the superfluous material may be trimmed off after the processing is completed.

In the present description, which is related to the processing of materials used in the method according to U.S. Pat. No. 3,774,029, already mentioned hereinbefore, it will be taken into account that the recording material 10 is processed with its recording layer in downward direction.

Figure 14:
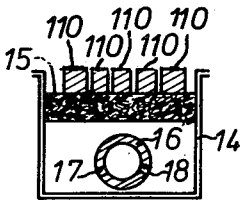
FIG. 14 is a sectional view of the applicator station of FIG. 2 along the line b—b', which is provided with supplementary distributing channels.
Figure 2:
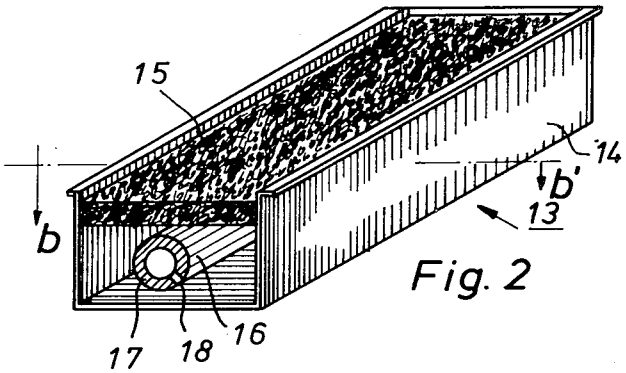
FIG. 2 is an isometric view of an applicator station used in a processing apparatus according to the invention.

In FIG. 2 is illustrated an applicator station 13 used in the processing apparatus according to the invention. It comprises a troughlike structure 14 which is provided at about 2 millimeters from its upper edges with a plate 15 of a porous material. Preferably, a sintered metal such as sintered copper is used for such plate. The plate has a spongelike appearance and its thickness may range between 2 and 10 millimeters. Processing liquid is pressed or pumped through the pipe 16 provided near the bottom of the trough, said pipe having a plurality of openings 17, 18 drilled in it, the axes of which forming an angle of about 45 degrees with respect to the water level. In this way, processing liquid may gradually rise in the trough 14, and is forced through the plate 15 of porous material. By the fact that the pores of the latter are purely arbitrarily arranged, no preferential flow is built-up, so that a homogeneous and stable layer of processing liquid is obtained at the top of the trough. The quality of the flow of liquid reaching the charge bearing surface of the material to be processed may be enhanced by providing a plurality of upstanding ridges or ledges 110 (FIG. 14), causing the processing liquid to flow in the space between said elements. In this way small irregularties in the structure of the porous member giving rise to a less uniform flow of processing liquid may be easily compensated. The amount of processing liquid which is not consumed during processing flows over the edges of the trough and returns back to a container (not shown) for recycling. A certain part of the liquid of the layer will be taken away by the charge pattern of the recording material to be processed when such material is moved over the trough in contact with the layer of processing liquid.

A major problem during a high quality processing cycle is the deposition of the processing liquid onto the material to be processed in the form of a uniform layer. A possible cause of imperfect deposition may be found in the bending of the recording material, especially when large sized formats are used. In medical radiography such formats may attain a width of, say 40 to 50 cm, so that already a considerable bending of the material may be observed when no further precautions are taken to prevent said phenomenon. In processing apparatus, intended for treating silver halide materials, this problem is unexisting by the fact that, in general, rollers which support the material over its full width are used the bending of which is almost zero due to the favourable ratio between their moment of inertia and their width.

For reasons described hereinbefore, the most convenient way of transporting the material 10 is by engaging it at its side edges with the help of two pairs of endless belts, or by a plurality of pairs of small transporting rollers situated at the same location as the endless belts.

Figure 3:
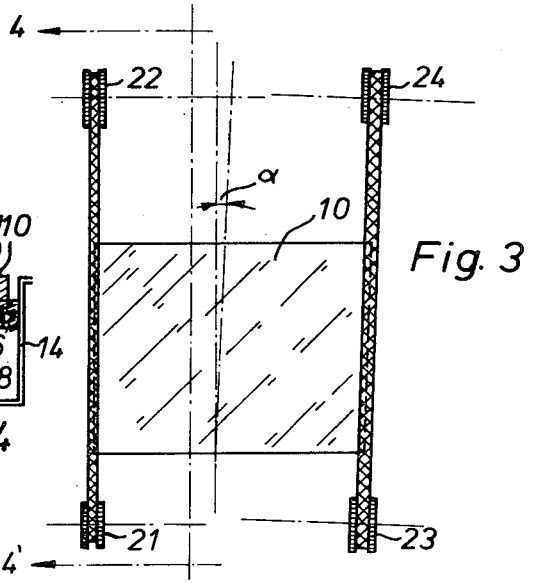
FIG. 3 is a top view of a transporting mechanism.
Figure 4:
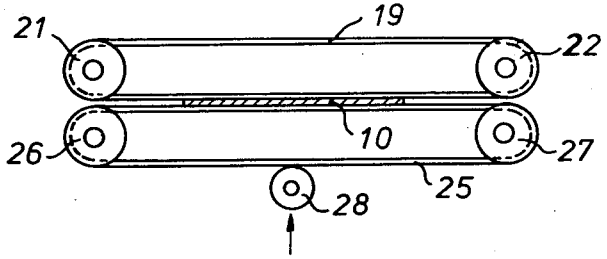
FIG. 4 is a sectional side view of the transporting mechanism of FIG. 3 on line 4—4'.

FIGS. 3 and 4 present a transporting mechanism which is capable of providing a high degree of tautness and flatness to the material 10. Two pairs of endless belts (shown are only the belts 19, 20 and 25) engage the material 10 at its side edges.

The endless belts may be tensioned for example by means of a pressure roller 28 (FIG. 4) by urging the latter to the belt in the sense indicated by the arrow. In this way the tensioning of the belts 19, 25 and of any other pair of belts may be adjusted at will. It will be appreciated by those skilled in the art that tensioning of the belts may be carried out by other means than pressure rollers. The endless belts are supported by roller pairs 21,22–23,24–26, 27–48,49 (see also FIGS. 8 and 9). The trajectories of belts 19 and 25 are slightly diverging from those of the other set of endless belts in that they form a small angle $\alpha$ with each other. In FIG. 3 this angle $\alpha$ has been exaggerately represented for the sake of illustration. In practice, said angle amounts only to 1 or 2 degrees. In so doing a good tautness of the recording material 10 is guaranteed because a sufficiently high force is constantly exerted at the edges of the latter. In practice, only one set of endless belts (in FIG. 3 the belt 20, and the underlying one) has to be mounted obliquely with relation to the direction of the recording material, whereas the other follows a straight longitudinal direction.

When the tension of the latter set of endless belts is taken somewhat greater than the tension of the obliquely mounted set, slipping of the edges of the recording material which are engaged by the diverging pair of endless belts may take place. In this way the material is neither stretched nor submitted to excessive lateral forces. In practice, the pressure of the set of endless belts which run straight longitudinally (19 and 25) is therefore adjusted to 1.7 kg/sq.cm whereas the pressure of the diverging pair is adjusted to about 1.2 kg/sq.cm.

It will be appreciated that when a plurality of small rollers are used which engage the side edges of the material 10, instead of two pairs of endless belts, one row of roller sets has to be positioned as described hereinbefore.

Figure 5:
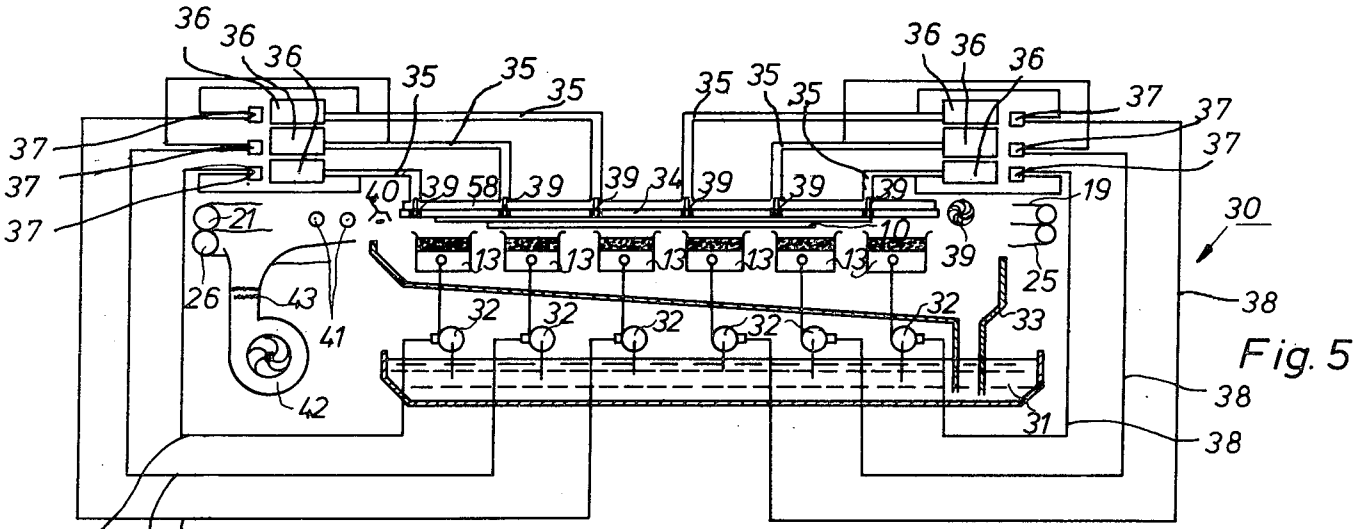
FIG. 5 is a cross-sectional view of a processing apparatus according to the invention.

In FIG. 5 is given a diagrammatic representation of the complete processing device 30 applied for processing the recording material 10.

The said material is introduced at the right side of the device in the bite of the endless belts 19 and 25. First, its back is uniformly wetted with the help of the wick 39 which is soaked with, for example, a water/alcohol mixture. In so doing, the conductivity of the layer occasionally provided at the back-side of the recording material 10, may be increased. In this way, also a good contact between the back of the recording material 10 and a backing plate 34, the latter serving as a grounded development electrode, is obtained.

Figure 7:
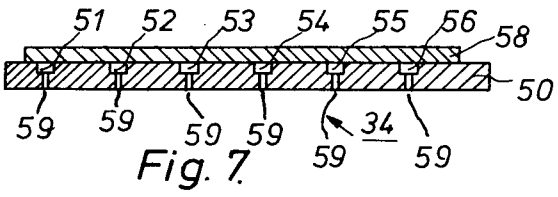
FIG. 7 is a sectional view of the electrode of FIG. 6 according to the line 7—7'.
Figure 6:
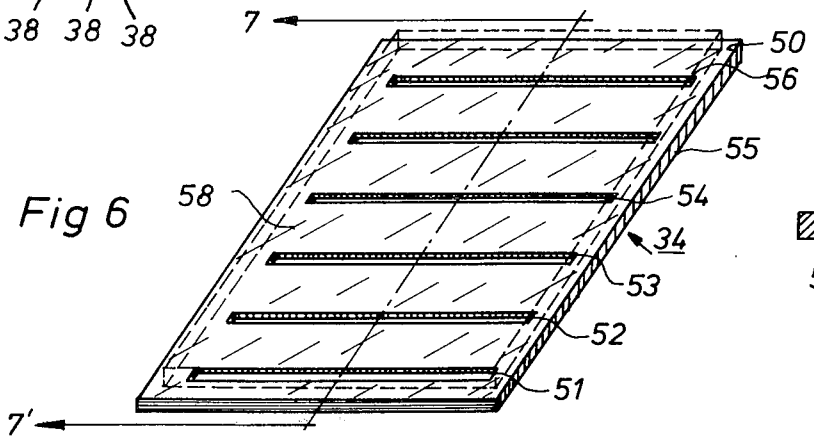
FIG. 6 is an isometric view of the backing electrode of the apparatus of FIG. 5.

For the structure of the backing plate 34, which will be further referred to as electrode 34, reference is also made to FIGS. 6 and 7. As may be seen, it is provided with a plurality of grooves 51 to 56, which are provided with holes 59 through which air may be sucked.

Referring again to FIG. 5 it may be seen that the recording material 10 during its travel through the apparatus passes with its charge bearing layer above a plurality of applicator stations 13 to which processing liquid under relatively high pressure is fed with the help of pumps 32 so that the processing liquid flows over the edges of its associated applicator station after having formed a liquid layer of a few millimeters high at the top of each applicator station. As already explained, the presence of sintered metal plates either or not combined with upstanding ridges in each station has as consequence that no special structure in the layer arises, so that processing faults such as streaks which frequently occur with prior art apparatus are completely prevented.

Each applicator station 13 is continuously supplied with processing liquid from a container 31 by means of an associated pump 32, whereby a layer of said liquid is formed. This layer is contacted by the recording material 10, passing over the applicator station, whereby part of the processing liquid is retained by the surface of the recording material 10. The residual processing liquid which is not taken away flows into the collecting vessel 33 and is forwarded again to the container 31 for re-use.

After processing, the material 10 has to be dried quickly. Therefore, a combination is provided composed of a corona device 40, infrared dryers 41 and a blower 42 which directs heated air onto the wet surface of recording material 10. In the embodiment shown, air is heated by heating element 43, which may be in the form of wire resistances, a tube system containing heated oil or any other heating device known in the art. The DC corona device 40 is based on the phenomenon of the "electric wind" for repelling the residual liquid which would adhere to the surface of the image side of the recording material and such liquid layer may be decreased from 30 to 7 microns. The other expedients positively dry the still wet image.

If desired, the last processing trough 13 may be connected via its associated pump to a supply of liquid in which no toner particles are present, so forming a station which may be compared with the rinsing station in classical photographic processing machines. In so doing excessive toner which does not adhere to image parts and which is still present in the uniform layer of liquid may easily be washed away, so that the risk of fog formation is greatly reduced. A cutting mechanism (not shown) may be provided after the drying station(s) in order to trim off the edges of the dried processed material in the case that no carrier sheet was used.

The pumps 32, associated with the plurality of applicator stations 13 are sequentially energized which energizing depends on the position taken by the recording material 10 at a given moment. The electrode 34 is provided with holes 59, to which a suitable source or sources of vacuum 36 may be connected via conduits 35. The sources of vacuum 36 are permanently energized, so that in the absence of the material 10, no substantial air pressure drop in the conduits 35 occurs. Once, however, the leading edge of the recording material 10 is masking the openings, a substantial air pressure drop is created in said conduits 35, whereinafter a pressure-sensitive microswitch 37 starts to energize its associated pump 32. As a consequence, the direct projection of processing liquid 31 into the holes 59 and further into conduits 35 is avoided, the recording material 10 is kept taut, and the conductivity enhancing liquid on the backside is evaporated to a great extent at the same time. As may be derived from FIG. 6, the canals 51 to 56 extend transversally with respect to the width of the electrode 34 and are in the form of grooves (see also FIG. 7) provided in a metal plate 50, the latter having preferably highly conductive properties. A cover plate 58 (drawn in dotted in FIG. 6) guarantees an airtight sealing.

It may be derived from the foregoing that an apparatus as described will largely suit the critical processing of advanced technology materials.

When, however, the need for such complicated processing is less pressing, the apparatus may be drastically simplified.

The apparatus may become less complicated, when the vacuum circuitry, shown in FIG. 5, and the accompanying regulating devices may be omitted.

A problem, however, that still remains is the elimination of the layer of conductivity enhancing liquid which is applied to the backside of the recording material 10 prior to processing (see FIG. 5) same.

Figure 8:
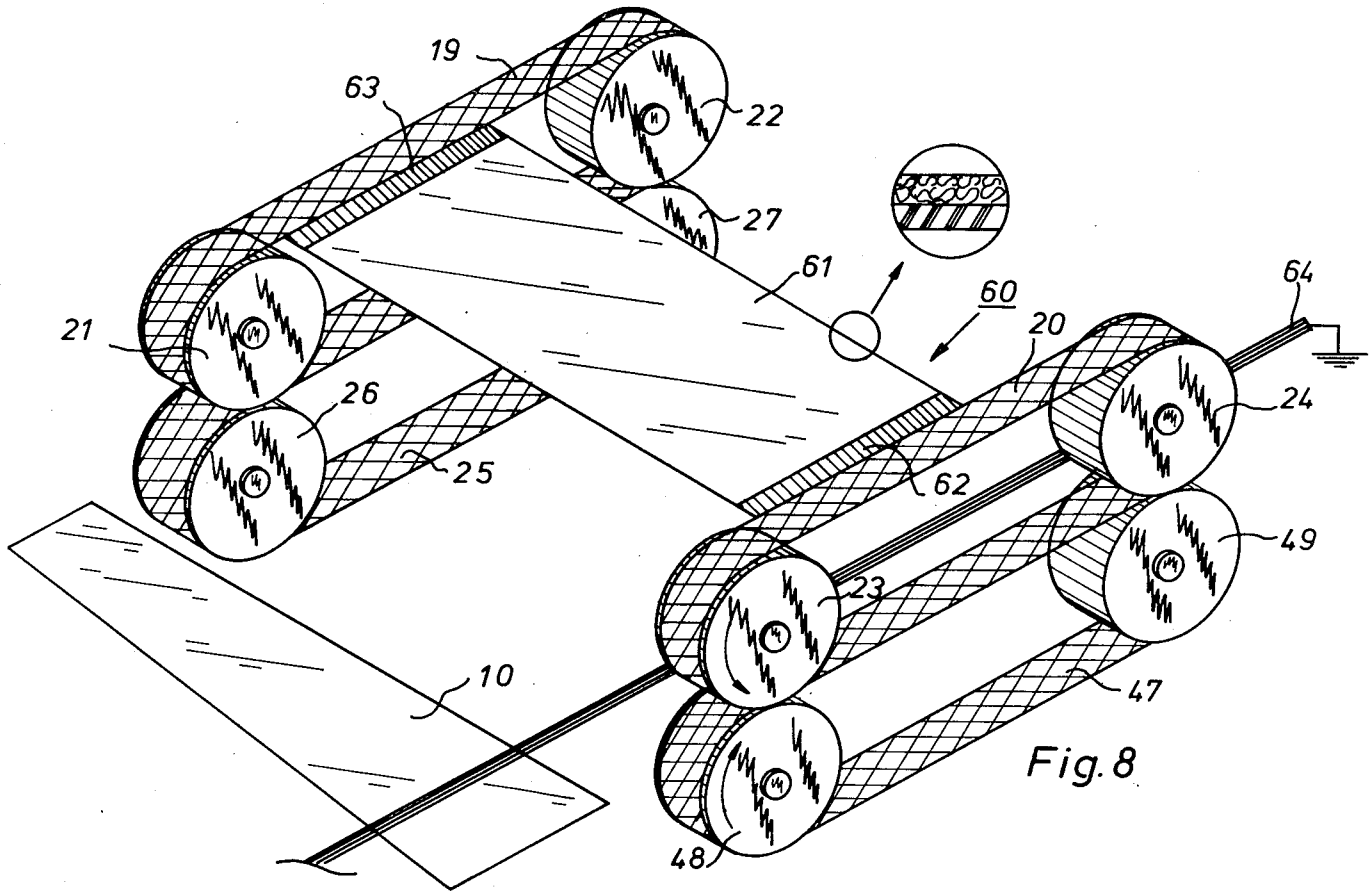
FIG. 8 is an isometric view of another embodiment of a transporting mechanism used in a processing apparatus according to the invention.

To this end, as depicted in FIG. 8, the transporting mechanism 60 is built-up by the roller pairs 21, 22 and 26, 27 at one side and the roller pairs 23, 24 and 48, 49 at the other side. These four roller pairs support the endless belts 19, 25, 20 and 47 respectively.

As may be derived from FIG. 8, the upper endless belts serve as support for at leaast one sheet 61 of porous material, wherein the term "porous" must be understood for as well a fully porous material as for a material which is porous at only one side. This sheet of porous material 61 is attached to the endless belts 19 and 20 with the help of straps 62, 63 made of rubber or other elastic material, for compensating the divergence between the trajectories of the endless belts.

Upon rotation of the endless belts, care must be taken for maintaining the exact synchronism between the motion of the belts carrying the porous material 61 and the motion of the recording material 10 to be processed. The wet backside of the latter material is made to contact the porous material and in the meantime contacts a grounded metal strip 64 serving as backing electrode during development.

By the fact that porous material 61 contacts the wet backside of the recording material 10 a sufficiently high conductivity of the backside for optimum developing the charges at the surface of the material is still guaranteed, while also a major part of the wetting liquid may be sucked up, once the sheet material leaves the developing station prior to its complete drying. The porous material 61 itself has sufficient time to dry during its "inactive" period. If necessary, drying of the latter itself may be accelerated by means of a blower (not shown). It will be appreciated, that the porous material itself may be in the form of an endless belt when desired.

The synchronism between the motion of the recording material 10 to be processed and the porous material 61 may be obtained by means sufficiently known in the art of electronic and/or pneumatic logic and which need no further explanation as they form no part of the invention.

For reasons of convenience, the metallic strip 64 too, may be executed in the form of an endless belt.

Embodiments of the porous material 61 may be either in the form of a sheet of fabric onto which a layer of rubber or a high polymeric material is coated or in the form of a sheet of fabric alone.

Figure 9:
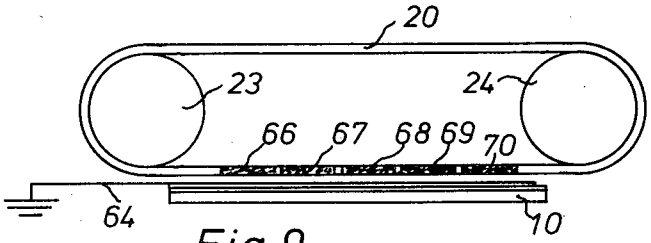
FIG. 9 is a sectional view of a part of another embodiment of the transporting mechanism of FIG. 8.
Figure 10:
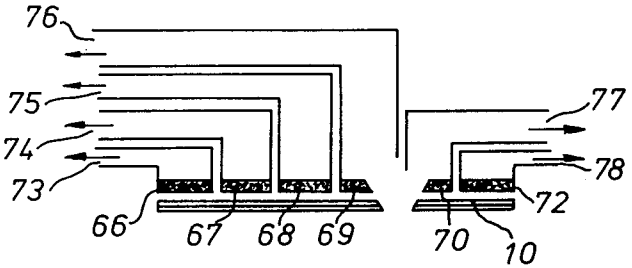
FIG. 10 is a sectional view of supplementary expedients used in combination with the transporting mechanism of FIG. 9.

Another embodiment of a transport mechanism which is illustrated in FIGS. 9 and 10 makes use of a porous material which is built-up as a kind of "Venetian blind." Small strips of a material which are analogous in structure as the porous material used in the processing stations may be applied for this purpose.

So, a plurality of strips 66 to 72 are used which, when positioned in close parallel relationship with the recording material 10 to be processed, first provide a conductive backing electrode, whereinafter they serve as carriers for the excess of conduction enhancing liquid which was taken up during processing. Then, they pass in front of a corresponding plurality of suction-pipes 73 to 78 each of which is connected to a suitable blower (not shown). In this way the liquid may evaporate and the strips are ready for re-use in a subsequent processing cycle.

In so doing, the same result is obtained as in the case a porous material made of fabric is used, but the reliability of the apparatus is increased due to the higher mechanical resistance and the anti-corrosive qualities of the sintered metallic strips.

Figure 11:
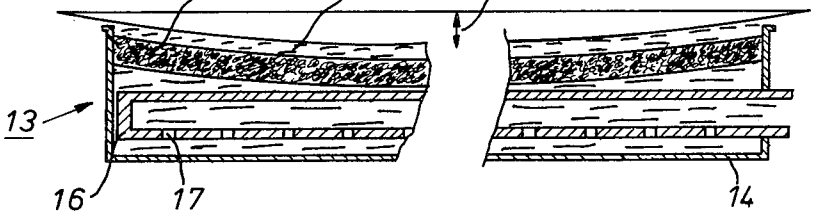
FIG. 11 is a longitudinal section of a modified embodiment of the applicator station of FIGS. 2 and 14.

In the simplified embodiment of an apparatus according to the invention, as mentioned hereinbefore, wherein the principle of using a vacuum source ensuring the complete flatness of the material to be processed is abandoned, the said material will undergo a bending 80 as illustrated in FIG. 11 in an exaggerated way.

Said figure represents a longitudinal sectional view of a processing station (the recording material passing over it being perpendicular to the plane of the page) as already shown in FIG. 2, but wherein the porous plate 15, or the ridges 110 (see FIG. 14) is/are bent in such a way that the curvature lies in concentric relationship with the transverse section of the sheet material 10. In this way, a homogeneous bead of liquid having a constant thickness is still guaranteed and the recording material 10 may be processed uniformly.

A problem which may arise when such simplified apparatus as described in used for processing of sheet or weblike recording materials, is the wetting of the backside of the latter when the trailing edge passes over an applicator station.

Indeed, when analyzing the different stages of a processing cycle, the following events are happening.

Firstly, when the leading edge of the recording material is presented in the vicinity of the layer of processing liquid, there is no exaggerated bending of that leading edge of the material and no contact between it and said layer is created. Once, however, the recording material covers the total upper area of the applicator station and its respective layer of processing liquid, a new situation is created, in that a mutual attraction is built-up between the liquid layer and the recording material due to electrostatic phenomena. As a consequence thereof, the material undergoes a bending, contacts the layer of processing liquid and remains adhering thereto due to the effect of surface tension. In this way the surface of the recording material may be uniformly wetted and processing is carried out easily. The bending of the recording material at its trailing edge, however, may be the cause that, when passing over an applicator station, developing liquid creeps over said edge and wets the backside. Indeed, the still bent recording material has not yet been released by the liquid, so that, temporarily, the level of processing liquid is at a higher position than the rear edge of the recording material.

As a consequence thereof, special precautions have to be taken in order to prevent this undesired phenomenon.

Figures 12, 13:
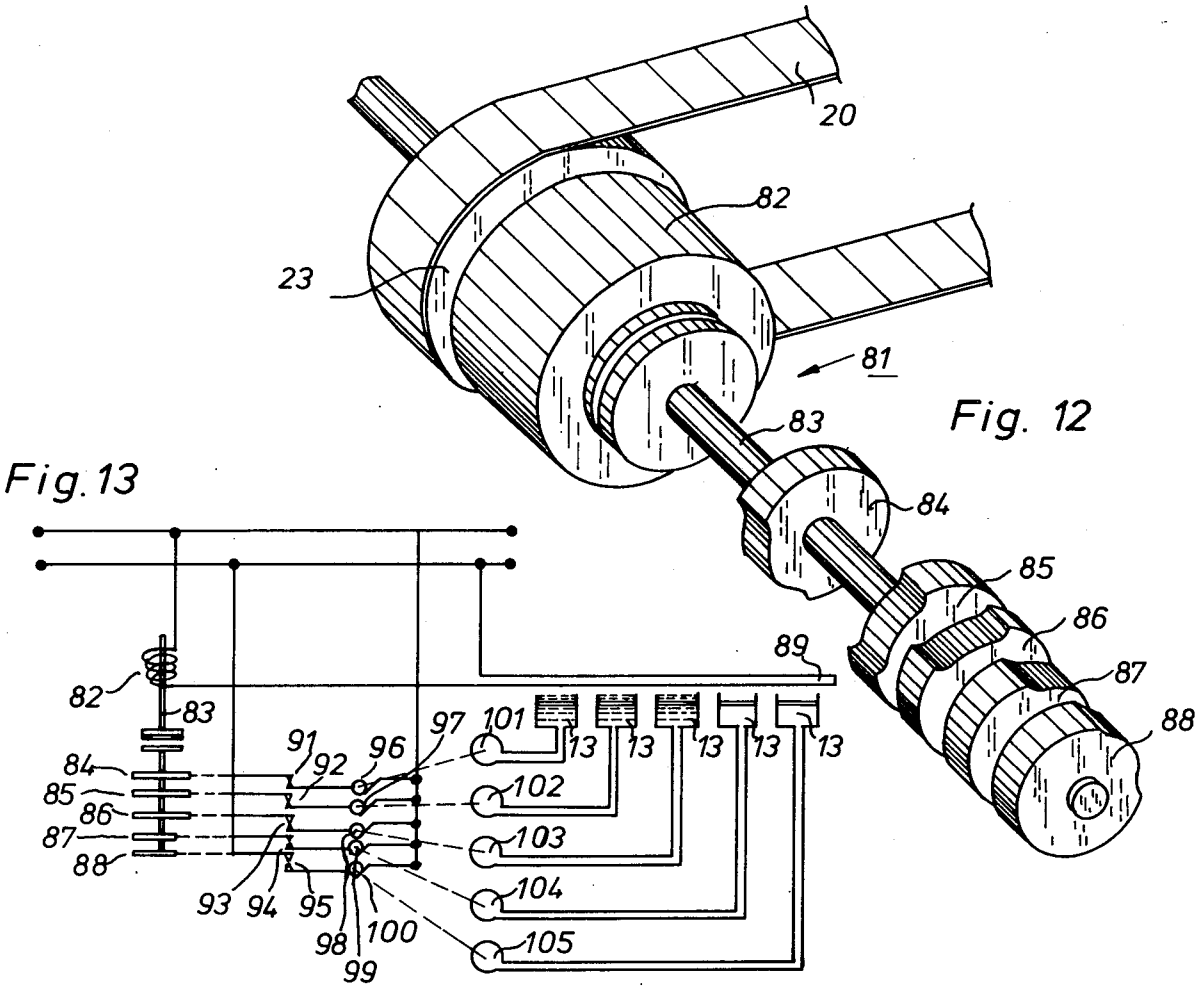
FIG. 12 is an isometric view of a switching device serving for regulating the sequential starting and stopping of the pumps.
FIG. 13 is a diagrammatic view of an electrical circuit used in combination with the switching device of FIG. 12.

In FIGS. 12 and 13 are shown a switching device and an electric circuitry by means of which said step may be accomplished.

FIG. 12 represents a mechanism 81 fixedly mounted on the shaft bearing the roller 23 over which runs the endless belt 20, forming part of the transporting mechanism. This shaft carries an electromagnetic friction clutch 82, which may drive a shaft 83 carrying a plurality of cams 84 to 88. If desired, the electromagnetic friction clutch 82 may be linked with the shaft 83 by means of a gear box (not shown).

Referring further to FIG. 13, it may be derived that the electromagnetic friction clutch 82 is actuated by the closing of a microswitch 89. Said microswitch 89 is located at the beginning of the first applicator station and serves to detect the passage of the leading edge of the recording material. Upon closing of the microswitch 89, the coupling between the electromagnetic friction clutch 82 and the cam bearing shaft 83 is performed and the latter starts to rotate. The cams 84 to 88 serve to open or to close a corresponding plurality of switches 91 to 95, preferably microswitches, the mobile contact of which serving as cam followers for the cams 84 to 88. When the cut away portion of a cam is contacted by a cam follower, the corresponding switch will open, as is shown for switches 94 and 95.

The switches 91 to 95 are series-connected with the motors 96-100 of the pumps 101 to 105, so that the opening of a switch de-energizes the pump associated therewith. In operation, the pumps 101 to 105 pump processing liquid to the applicator stations 13 so that upon de-energizing a pump, the supply of processing liquid is automatically interrupted. The structure of the cams 84 to 88 and the rotation of the shaft 83 are so designed that opening of a switch 91 to 95 occurs at the moment that the trailing edge of the material to be processed is just above the applicator station fed by the pump associated with said switch.

With the help of an arrangement as described hereinbefore, cutting off the supply will occur in sequence until the cam follower contacting the last cam resets its associated switch in closed position. Another switch (not represented) which may be located in a downstream section of the apparatus and which takes care of the "HOLD"-condition of the clutch during processing, provides for the de-energizing of the clutch 82 after the trailing edge of the material sheet has passed the last applicator station. At that moment, all pumps are again pumping and the processing station is ready for receiving another sheet or web of recording material to be processed. The processed material is then subjected to a rinsing and drying process, whereinafter the excess of material in the vicinity of its four edges may be trimmed off. As this last treatment may be carried out by means which are sufficiently known in the art, it has not been illustrated.

It will also be clear that the regulation of the sequential de-energizing of the pumps may be carried out with other means than an electromagnetic clutch with a cam-bearing shaft. If desired, a fully electronic hardware device may be used for this purpose.

We claim:

1. An apparatus for use in processing a recording material in sheet or web-form comprising at least one open-topped trough for holding processing liquid, means for guiding sheet recording material through the apparatus along a path passing over and in proximity to the opening of each such trough, individual pump means for each such trough for pumping liquid upwardly into said trough to cause overflow of liquid through the trough opening and bring the surface of the liquid in each such trough into contact with the bottom surface of a recording material during its movement along said path, means operatively associated with each such pump for operating each pump upon passage of the leading edge of said recording material over the corresponding trough and for stopping the pumping of liquid to the corresponding trough before the trailing edge of the sheet material reaches the surface of the liquid in such trough, each such trough having a porous member disposed therein just below the opening thereof and an inlet for the admission of processing liquid into the interior of the trough beneath said porous member, said porous member carrying on its upper surface a plurality of generally equispaced upstanding ridges for promoting uniform flow of processing liquid in the spaces between said ridges.

2. Apparatus according to claim 1, including a plurality of such troughs disposed in series along the said material path and each of the troughs has an associated pump.

3. Apparatus according to claim 2, which further comprises:

liquid collecting means in order to collect the excess processing liquid flowing over the edges of the applicator stations.

4. Apparatus according to claim 2, in which one of said troughs contains a rinsing liquid.

5. Apparatus according to claim 1, in which the means for guiding the web of sheet of recording material through the apparatus are in the form of two cooperating pairs of endless belts, each pair engaging said sheet material along one of its side edges.

6. Apparatus according to claim 5, in which the trajectories of said pairs of endless belts slightly diverge from each other.

7. Apparatus according to claim 5, in which the trajectory of one pair of endless belts runs longitudinally of the material path, whereas the other pair of endless belts diverges from said direction.

8. Apparatus according to claim 7, in which the nip pressure of the pair of endless belts running longitudinally is greater than the nip pressure of the pair of endless belts following a divergent trajectory.

9. Apparatus according to claim 1, in which said porous member has a rigid structure.

10. Apparatus according to claim 1, in which said porous member is made of sintered copper.

11. Apparatus according to claim 1, including means to uniformly wet the backside of the recording material prior to processing in order to increase the electrical conductivity of the latter.

12. Apparatus according to claim 1, including means for drying the recording material after its passage over the trough.

13. Apparatus according to claim 12, in which said drying means comprises the combination of a corona generating device infrared sources and a blower which guides drying air in contact with electrical heating elements.

14. Apparatus for processing recording material according to claim 1, which further comprises:

two pairs of endless belts located at each side of the apparatus for transporting the recording material through the apparatus with its recording face in contact with each of the layers of processing liquid, and an absorbing member, elastically connected with the upper one of each of said pair of endless belts and adapted to contact the backside of the recording material, at least during the period that the latter contacts the layers of processing liquid.

15. Apparatus according to claim 14, in which said absorbing member is in the form of a tissue-like structure.

16. Apparatus according to claim 14, in which said absorbing member is in the form of a combination of plates of sintered material passing in front of a suction-pipe.

17. An apparatus for use in processing a recording material in sheet or web-form comprising at least one open-topped trough for holding processing liquid, means for guiding sheet recording material through the apparatus along a path passing over and in proximity to the opening of each such trough, individual pump means for each such trough for pumping liquid upwardly into said trough to cause overflow of liquid through the trough opening and bring the surface of the liquid in each such trough into contact with the bottom surface of a recording material during its movement along said path, and control means operativly associated with each such pump for operating each pump upon passage of the leading edge of said recording material over the corresponding trough and for stopping the pumping of liquid to the corresponding trough before the trailing edge of the sheet material reaches the surface of the liquid in such trough, said control means including suction means at each such trough for obstruction by the passage of said recording material thereacross, and means for detecting pressure changes in said suction means due to such obstruction and operating said pump in accordance with such detected changes.

18. Apparatus according to claim 17, including a flow distributor in each such trough for promoting uniformity of upward liquid flow over the whole plan area of the opening thereof.

19. Apparatus according to claim 11, in which electrode means is provided contacting the backside of said recording material upon passage of same through the apparatus.

20. Apparatus according to claim 19, in which said electrode means is in the form of a metallic strip.

21. Apparatus according to claim 19, in which said electrode means is in the form of a metallic plate.

22. Apparatus according to claim 21, in which said metallic plate is provided with a plurality of transversally extending rows of holes, each of said rows being located above a trough, wherein a vacuum may be applied through said holes to form said suction means.

23. Apparatus according to claim 22, in which the pump means associated with an applicator station is energized in response to the passage of the leading edge of the recording material in front of the associated row of holes.

24. An apparatus for use in processing a recording material in sheet or web-form comprising at least one open-topped trough for holding processing liquid, means for guiding sheet recording material through the apparatus along a path passing over and in proximity to the opening of each such trough, individual pump means for each such trough for pumping liquid upwardly into said trough to cause overflow of liquid through the trough opening and bring the surface of the liquid in each such trough into contact with the bottom surface of a recording material during its movement along said path, and control means operatively associated with each such pump for operating each pump upon passage of the leading edge of said recording material over the corresponding trough and for stopping the pumping of liquid to the corresponding trough before the trailing edge of the sheet material reaches the surface of the liquid in such trough, said control means including:

first switch means responsive to the passage of the leading edge of the recording material over the first trough, clutch means energized by said first switch means, and driving when energized a shaft on which a plurality of timing cams are mounted, one for each such trough, and a plurality of second switch means, each following one of said plurality of timing cams and controlling the operation of the respective pump.

25. Apparatus according to claim 34, in which said clutch means is fixedly secured to the shaft of one of the endless belts for transporting the recording material along said path.

* * * * *